US006135864A

United States Patent [19]

Kenny et al.

[11] Patent Number: 6,135,864

[45] Date of Patent: Oct. 24, 2000

[54] SOLID PHASE WATER SCRUB FOR DEFECT REMOVAL

[75] Inventors: Danny Kenny; Keith Lindberg, both of Sherman, Tex.

[73] Assignee: MOS EPI, Inc., Sherman, Tex.

[21] Appl. No.: 09/233,005

[22] Filed: Jan. 19, 1999

Related U.S. Application Data

[60] Provisional application No. 60/072,051, Jan. 21, 1998.

[51] Int. Cl.[7] ..... B24B 1/00

[52] U.S. Cl. ..... 451/59; 451/36

[58] Field of Search ..... 451/41, 36, 59, 451/28; 134/1.3, 1.2

[56] References Cited

U.S. PATENT DOCUMENTS 5,283,989 2/1994 Hisasue et al. ..... 51/410
5,348,615 9/1994 Gupta ..... 156/635

*Primary Examiner*—Timothy V. Eley
*Assistant Examiner*—Dung Van Nguyen
*Attorney, Agent, or Firm*—Haynes and Boone, LLP

[57] ABSTRACT

A system and method for using solid-phase water scrub to remove defects from a wafer surface is disclosed. The method includes the steps of placing the wafer proximate to a frozen substrate and moving the wafer relative to the frozen substrate, thereby causing a portion of the frozen substrate to liquefy. As a result, defects are effectively removed from the wafer's surface.

11 Claims, 1 Drawing Sheet

SOLID PHASE WATER SCRUB FOR DEFECT REMOVAL

CROSS REFERENCE TO RELATED APPLICATIONS

This application relies on U.S. Provisional Patent Application No. 60/072,051, entitled "Solid Phase Water Scrub for Defect Removal," filed Jan. 21, 1998.

TECHNICAL FIELD

This invention relates generally to semiconductor wafer production.

BACKGROUND OF THE INVENTION

In general, semiconductor wafers are prepared in several steps, including (1) growing a single crystal ingot out of molten silicon, (2) sawing the single crystal ingot into wafers, (3) shaping or lapping the wafers, (4) performing a rough polish, and (5) depositing an epi layer of silicon substrate. The epi layer is often deposited using chemical vapor, high temperature deposition to form a single crystal silicon layer on the surface of the wafer. Once the wafers have been prepared, they are provided to a fabrication facility (fab) for further processing.

As fabs are processing smaller and smaller line widths and devices are continually shrinking, the wafer surface effects the entire fab processing. Furthermore, a particle that used to be "invisible" can now completely ruin a device. Therefore, the step of polishing becomes extremely important.

Conventional polishing includes placing the wafer on a chuck, such as a vacuum chuck that holds the wafer in place, and spraying the surface of the wafer with deionized water. Either the wafer or the outlet for deionized water is rotated to move the particles from the center of the wafer towards the outside of the wafer. Combinations of high pressure spray, a fast spinning wafer chuck and a brush placed in very close proximity to the wafer are often used. The high pressure spray effectively shoots the particles out of the wafer and the fast spinning chuck uses centrifugal force to remove the particles. The brush is a sponge-like piece for forcing a thin layer of water between it and the wafer to create pressure waves in the water.

The spray and spinning chuck methods are inefficient in removing particles, especially smaller particles. The brush method works well with the small particles, but becomes contaminated with and traps the larger particles. To effectively use the brush method, each brush must be routinely replaced. However, new brushes incur a break in period (several days) during which their cleaning quality is not optimized

SUMMARY

In response to the above-described problems, a system and method for using solid-phase water scrub to remove defects from a wafer surface is disclosed. In one embodiment, the method includes the steps of placing the wafer proximate to a frozen substrate and moving the wafer relative to the frozen substrate, thereby causing a portion of the frozen substrate to liquefy. As a result, defects are effectively removed from the wafer's surface.

DESCRIPTION OF THE PREFERRED EMBODIMENT

Figure 1:
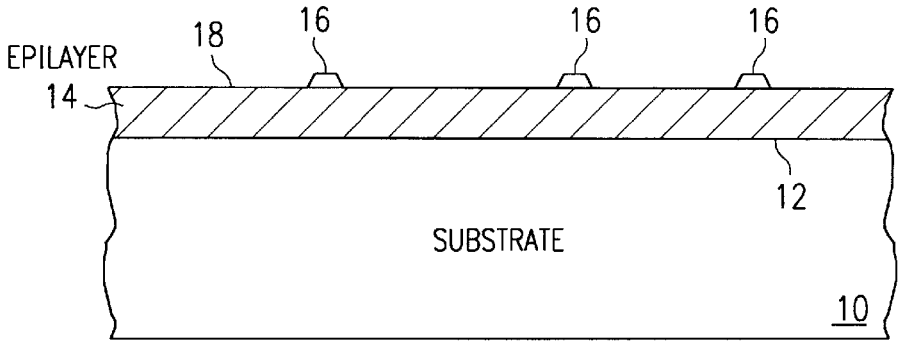
FIG. 1 is a cross sectional view of a wafer with an epitaxial layer deposited thereon.

Referring to FIG. 1, a semiconductor wafer substrate 10 has deposited on its top surface 12 an epitaxial layer 14. Fabricating an epitaxial layer on a wafer is well known in the art and will not be further discussed. However, small particles 16 exist on a top surface 18 of the epilayer 14.

Figure 2:
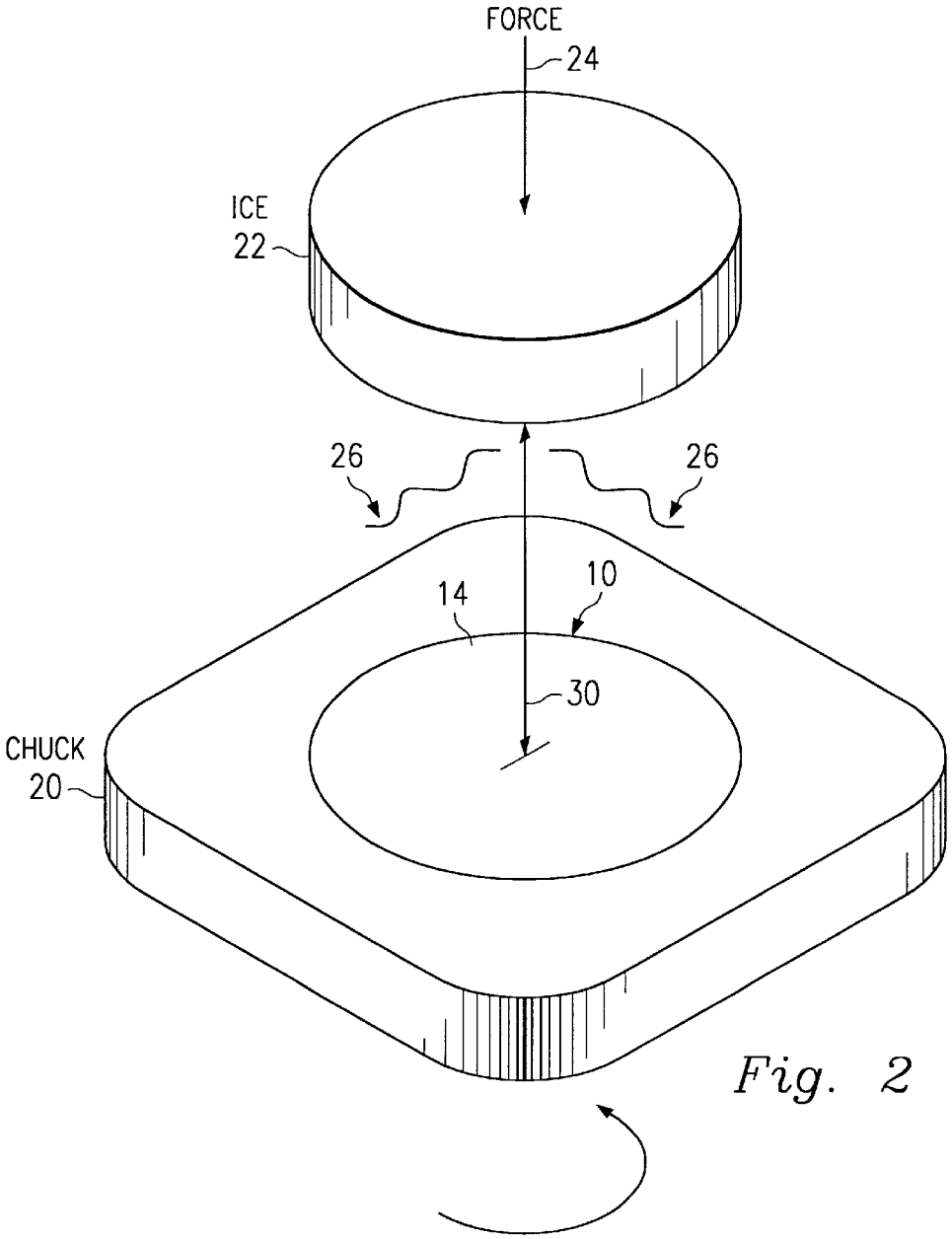
FIG. 2 is a side view of the wafer of FIG. 1 placed on a chuck and proximate to a piece of frozen deionized water.

Referring to FIG. 2, the wafer 10 is placed on a chuck 20 with the epilayer 14 positioned opposite the chuck (the epilayer is the top side of the wafer, as viewed in the drawing). A piece of frozen deionized ice 22 is located above the wafer 10.

In operation, the chuck 20 spins, thereby spinning the wafer 10. A force 24 is applied to the ice 22 to propel the ice towards the top surface of the wafer 10. As the ice 22 nears the wafer, portions of the frozen deionized ice change to a liquid 26. The liquid 26 is under high pressure, relative to the force 24. The ice 22 never actually touches the wafer 10. Instead, it remains a distance 30 provided by the liquid 26.

The high pressure provided by the ice 22 and liquid 26 is very effective at removing the particles 16. Several additional benefits also exist. For one, after cleaning several wafers 10, the surface of the ice 22 eventually conforms almost exactly to the wafer. For another, at very low temperatures, such as near 0 °C., attractive forces between the particles 16 and the wafer 10 are reduced. This is primarily due to a reduction in the Van Der Wall forces therebetween. Van Der Wall forces are forces between atoms due to a sharing of electrons. By lowering the temperature, atomic movement is reduced and the lower attraction between the particles 16 and the wafer 10 facilitates their separation.

Another benefit is that as the ice 22 melts, the liquid 26 runs away from the wafer 10, thereby removing the particles 16.

What is claimed is:

1. A method for removing defect particles from a semiconductor wafer, the method comprising the steps of:

placing the wafer proximate to a frozen substrate;

moving the wafer relative to the frozen substrate; and causing a portion of the frozen substrate to liquefy, thereby removing the defect particles without removing part of the wafer.

2. The method of claim 1 wherein the frozen substrate is a piece of frozen deionized ice.

3. The method of claim 1 wherein the frozen substrate does not react with the wafer.

4. The method of claim 1 wherein the frozen substrate does not react with the defect particles.

5. The method of claim 1 wherein the frozen substrate does not contact the wafer.

6. The method of claim 1 wherein a distance is kept between the frozen substrate and the wafer by the liquefied portion of the frozen substrate.

7. A method for removing defect particles from a semiconductor wafer, the method comprising the steps of:

placing the wafer proximate to a frozen substrate;

spinning the wafer relative to the frozen substrate; and causing a portion of the frozen substrate to liquefy, thereby removing the defect particles from the wafer without having the frozen substrate contact the wafer directly and without removing part of the wafer.

8. The method of claim 7 wherein the frozen substrate is a piece of frozen deionized ice.

9. The method of claim 7 wherein the frozen substrate does not react with the wafer.

10. The method of claim 7 wherein the frozen substrate does not react with the defect particles.

11. The method of claim 7 wherein a distance is kept between the frozen substrate and the wafer by the liquefied portion of the frozen substrate.

* * * * *